US009134053B2

(12) United States Patent
Lu

(10) Patent No.: US 9,134,053 B2
(45) Date of Patent: Sep. 15, 2015

(54) VEHICLE REFRIGERATOR HAVING A LIQUID LINE SUBCOOLED VAPOR CYCLE SYSTEM

(75) Inventor: Qiao Lu, Placentia, CA (US)

(73) Assignee: B/E AEROSPACE, INC., Wellington, FL (US)

( * ) Notice: Subject to any disclaimer, the term of this patent is extended or adjusted under 35 U.S.C. 154(b) by 689 days.

(21) Appl. No.: 13/215,456

(22) Filed: Aug. 23, 2011

(65) Prior Publication Data

US 2013/0047630 A1 Feb. 28, 2013

(51) Int. Cl.

| | |
|---|---|
| ***F25B 21/02*** | (2006.01) |
| ***F25B 40/00*** | (2006.01) |
| ***F25B 40/02*** | (2006.01) |
| ***F25B 47/02*** | (2006.01) |
| ***F25B 49/02*** | (2006.01) |

(52) U.S. Cl.

CPC ..... *F25B 21/02* (2013.01); *F25B 40/00* (2013.01); *F25B 40/02* (2013.01); *F25B 47/022* (2013.01); *F25B 49/02* (2013.01); *F25B 2313/029* (2013.01)

(58) Field of Classification Search

CPC ..... F25B 21/00; F25B 21/02; F25B 21/04; F25B 40/00; F25B 40/02; F25B 2321/02; F25B 2321/021; F25B 2321/023

USPC ..... 62/3.2, 3.6, 3.61, 175

See application file for complete search history.

(56) References Cited

U.S. PATENT DOCUMENTS

| | | | | |
|---|---|---|---|---|
| 4,215,555 | A | 8/1980 | Cann et al. | |
| 4,951,476 | A * | 8/1990 | Yamamoto et al. | 62/163 |
| 5,186,020 | A | 2/1993 | Rockenfeller et al. | |
| 5,379,833 | A | 1/1995 | Mathews | |
| 5,927,102 | A * | 7/1999 | Matsuo et al. | 62/509 |
| 5,941,086 | A | 8/1999 | Petrulio et al. | |
| 6,003,319 | A | 12/1999 | Gilley et al. | |
| 6,499,306 | B2 | 12/2002 | Gillen | |
| 6,973,799 | B2 | 12/2005 | Kuehl et al. | |
| 7,007,501 | B2 | 3/2006 | Hu | |
| 7,013,658 | B2 | 3/2006 | Dobmeier et al. | |
| 7,137,273 | B2 | 11/2006 | Ozaki et al. | |
| 7,231,778 | B2 | 6/2007 | Rigney et al. | |
| 7,310,953 | B2 | 12/2007 | Pham et al. | |
| 7,318,325 | B2 | 1/2008 | Rini et al. | |
| 7,444,830 | B2 | 11/2008 | Moran et al. | |
| 2005/0210884 | A1 * | 9/2005 | Tuskiewicz et al. | 62/3.6 |

(Continued)

FOREIGN PATENT DOCUMENTS

| | | | |
|---|---|---|---|
| WO | 2009/006918 | A1 | 1/2009 |
| WO | WO 2009/058837 | A1 | 5/2009 |

OTHER PUBLICATIONS

JP 2000-329414 (English Abstract).*

(Continued)

*Primary Examiner* — Jonathan Bradford

(74) *Attorney, Agent, or Firm* — Drinker Biddle & Reath LLP

(57) ABSTRACT

A vapor cycle refrigeration system includes a thermoelectric device (TED) as a sub-cooler to sub-cool liquid refrigerant exiting a condenser to increase cooling capacity of an evaporator and pull down temperature within a refrigerated compartment quickly. The TED sub-cooler is turned off after initial temperature pull down and is not operated during steady state operation for maintenance of the compartment temperature.

20 Claims, 9 Drawing Sheets

(56) References Cited

U.S. PATENT DOCUMENTS

| | | | | |
|---|---|---|---|---|
| 2007/0101739 | A1* | 5/2007 | Akei et al. | 62/238.6 |
| 2008/0087039 | A1 | 4/2008 | Reed et al. | |
| 2008/0105404 | A1* | 5/2008 | Luo | 165/104.21 |
| 2008/0223056 | A1* | 9/2008 | Heinbokel et al. | 62/225 |
| 2009/0266084 | A1 | 10/2009 | Radhakrishnan et al. | |
| 2010/0071384 | A1* | 3/2010 | Lu et al. | 62/3.2 |
| 2010/0071386 | A1 | 3/2010 | Reiss et al. | |

OTHER PUBLICATIONS

Supplementary European Search Report and written opinion issued in related application EP12826015.5, Mar. 12, 2015, 7 pages.

* cited by examiner

VEHICLE REFRIGERATOR HAVING A LIQUID LINE SUBCOOLED VAPOR CYCLE SYSTEM

BACKGROUND

Embodiments relate to refrigeration equipment. More specifically, embodiments relate to a vehicle refrigerator having a liquid line sub-cooled vapor cycle system.

Conventional refrigeration units for chilling food and beverages used in vehicles such as aircraft and other galley food service systems include vapor cycle systems that use a fluid refrigerant to chill air for circulation in a compartment that stores food and beverages. In general, vapor cycle systems for refrigeration units are designed to maintain set temperatures as required for steady state heat loads. However, when a refrigeration unit is first turned on to chill food and beverages, the heat load is much larger than steady state because the temperature in the compartment holding the food and beverages must typically be pulled down by a large amount, for example from an ambient air temperature (e.g., 72 degrees Fahrenheit (F)) to a refrigerator or freezer temperature (e.g., 39 degrees or 0 degrees F.). It is generally desirable for the temperature to be pulled down as quickly as possible so that the food and beverages are at an ideal serving temperature shortly after being loaded on the vehicle in preparation for embarking on a journey.

However, in order for a conventional vapor cycle system to pull down the temperature more quickly, the components of the vapor cycle system would need to be made larger and heavier. Increasing the size and weight of the components is in conflict with the need for systems onboard vehicles such as aircraft to be made smaller and lighter in order to save space and weight, and reduce total life cycle costs including fuel consumption. Therefore, there is a need to increase the cooling capacity of vapor cycle systems of refrigeration units for vehicles to increase the speed with which the temperature of food and beverage compartments can be pulled down without significantly increasing the size and weight of the refrigeration units.

SUMMARY

According to an embodiment, a refrigeration system that cools a compartment includes: a compressor, a condenser, a thermoelectric device (TED) sub-cooler, an expansion valve, an evaporator, and tubing adapted to transport refrigerant through the refrigeration system in a circulation order from the compressor to the condenser to the TED sub-cooler to the expansion valve to the evaporator and back to the compressor again.

According to another embodiment, a method of controlling a refrigeration system including a compressor, a condenser, a thermoelectric device (TED) sub-cooler, an expansion valve, an evaporator, and tubing adapted to transport refrigerant through the refrigeration system in a circulation order from the compressor to the condenser to the TED sub-cooler to the expansion valve to the evaporator and back to the compressor again includes: inputting sensor data; determining whether a measured temperature of the compartment is greater than or equal to a preset threshold; controlling the TED sub-cooler when the temperature is greater or equal to the preset threshold; not operating the TED sub-cooler when the temperature is less than the preset threshold; and controlling motors and valves of the refrigeration system according to the sensor data to maintain a set temperature of the compartment within a predetermined maintenance range.

BRIEF DESCRIPTION OF THE DRAWINGS

Exemplary embodiments are shown in the attached drawings. In the drawings.

DETAILED DESCRIPTION

While the following embodiments are described with reference to a refrigerator for an aircraft galley, this should not be construed as limiting. Embodiments may also be used in other vehicles such as ships, buses, trucks, automobiles, trains, recreational vehicles, and spacecraft, or in terrestrial settings such as offices, stores, homes, cabins, etc. Embodiments may also include air chillers and liquid chillers in addition to refrigerators.

Figure 1:
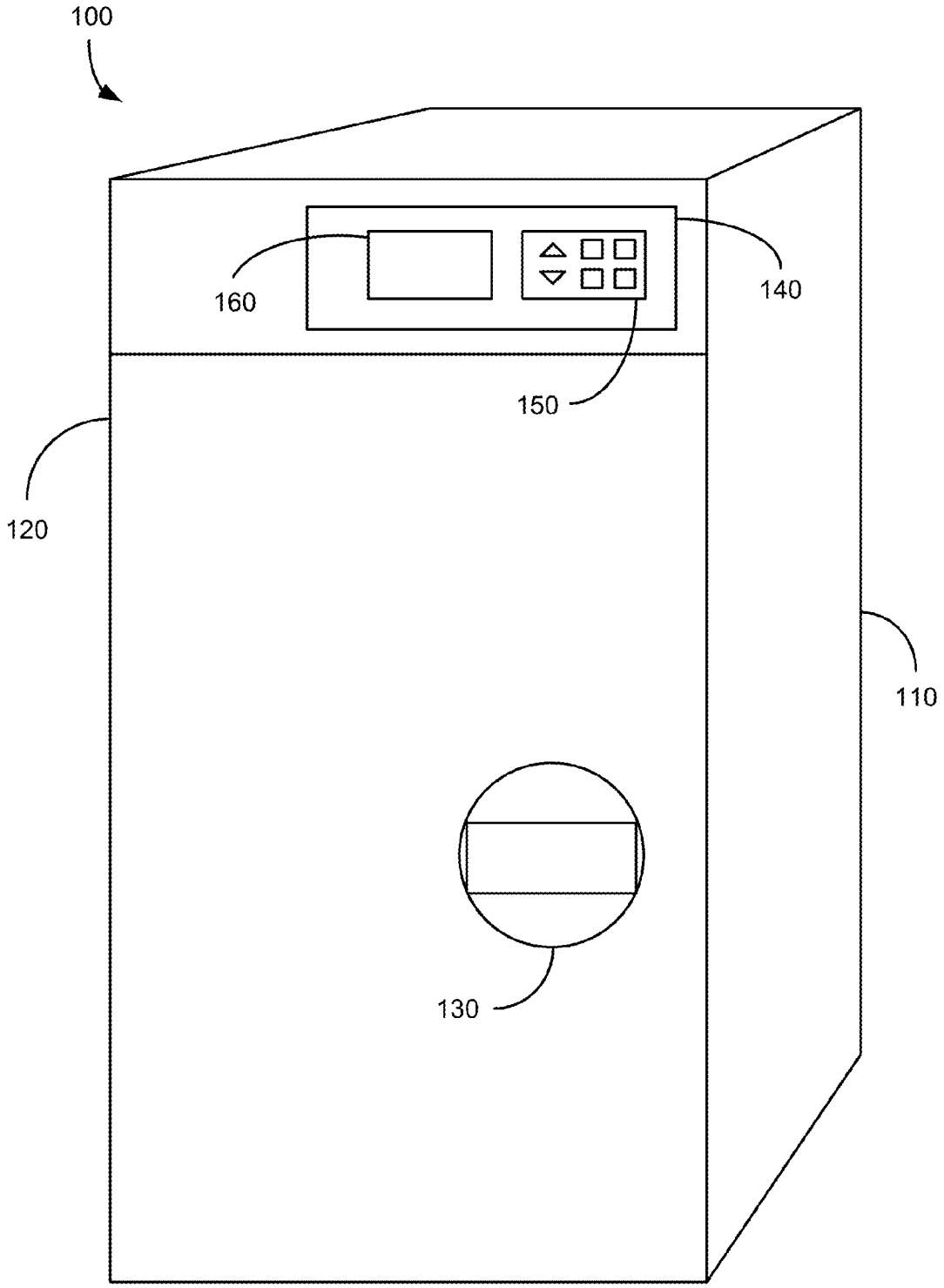
FIG. 1 illustrates a perspective view of an aircraft galley refrigerator, according to an embodiment.

FIG. 1 illustrates a perspective view of an aircraft galley refrigerator 100, according to an embodiment. The aircraft galley refrigerator 100 may be a line replaceable unit (LRU), and may provide refrigeration functionality while the aircraft is both on the ground and in flight. The refrigeration may be provided using a cooling system that may include a chilled liquid coolant system, a vapor cycle system, and/or a thermoelectric cooling system. The refrigerator 100 may be designed according to an ARINC 810 standard. The refrigerator 100 may be configured to operate using an electrical power source such as three phase 115 or 200 volts wild frequency alternating current (AC) at a frequency of 360 to 900 Hz. The refrigerator 100 may employ AC to DC power conversion to provide a predictable and consistent power source to motors and/or valve actuators. The refrigerator 100 may also include a polyphase transformer (e.g., a 15-pulse transformer) to reduce current harmonics reflected from the refrigerator 100 back into an airframe power distribution system with which the refrigerator 100 may be coupled.

The refrigerator 100 includes an enclosure 110 (e.g., a chassis) having a door to a refrigerated compartment 120. The refrigerated compartment 120 may include an inner liner and thermal insulation. The inner liner may be constructed of stainless steel. The inner liner and/or the enclosure 110 may be grounded to provide a Faraday shield to help shield the refrigerator 100 from external electromagnetic interference (EMI) influences while containing internally generated high-frequency energy. Various embodiments of the refrigerator 100 may also include an EMI filter to reduce susceptibility to conducted EMI and emissions of EMI. The enclosure 110 may also include mounting rails, a removable air filter, a bezel, and wheels. The door to the refrigerated compartment 120 may include a door handle 130 with which the door may be opened or closed.

The refrigerator 100 may also include a control panel 140 having one or more input devices (e.g., control buttons or switches) 150, and a display panel (e.g., an LCD display or LED's) 160. The display panel 160 may provide a user interface display. The display panel 160 may be mounted on a grounded backplane to reduce RF emissions. An Indium Tin Oxide (ITO) on-polymer layer may be employed behind a display glass of the display panel 160 to block or reduce RF energy radiation.

Figure 2:
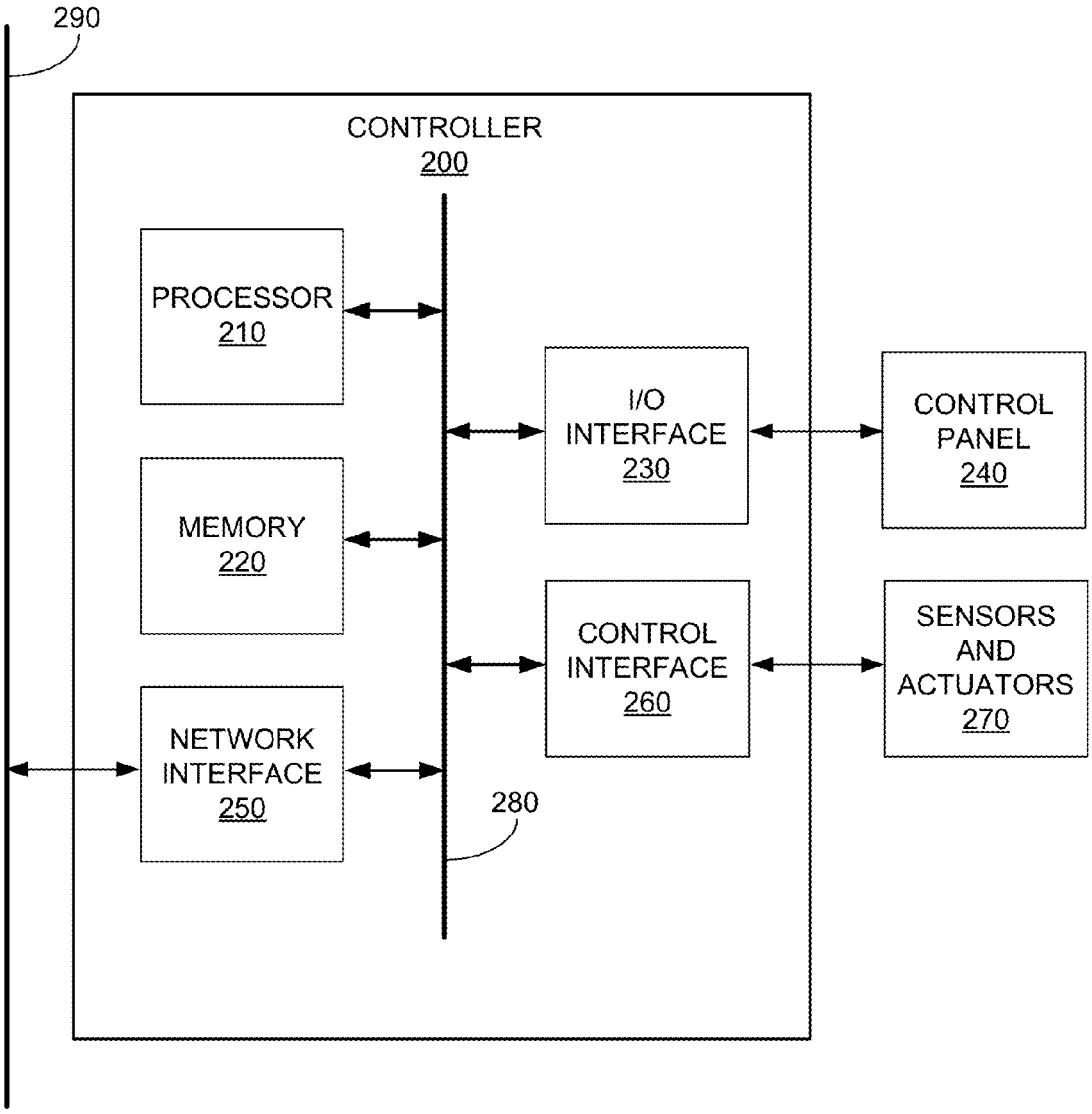
FIG. 2 is a block diagram of a controller for an aircraft galley refrigerator, air chiller, or liquid chiller, according to an embodiment.

FIG. 2 is a block diagram of a controller 200 for an aircraft galley refrigerator, air chiller, or liquid chiller, according to an embodiment. The controller 200 may be coupled with a control panel 250 via an I/O interface 230. The controller 200 may be included in the refrigerator 100 and the control panel 250 may be an embodiment of the control panel 140 such that the controller 200 is coupled with the input devices 150 and the display panel 160 of the control panel 140 via the I/O interface 230. The controller 200 may receive input commands from a user via the input devices 150, such as turning the refrigerator on or off, selecting an operation mode, and setting a desired temperature of the refrigerated compartment 120. The controller 200 may output information to the user regarding an operational status (e.g., operational mode, activation of a defrost cycle, shut-off due to over-temperature conditions of the refrigerated compartment 120 and/or components of the refrigerator, etc.) of the refrigerator using the display panel 160. The controller 200 may be coupled with the input devices 150 and the display panel 160 using shielded and twisted cables, and may communicate with the input devices 150 and/or the display panel 160 using an RS-232 communication protocol due to its electrically robust characteristics. Similar display panels and input devices may also be present on embodiments of air chillers and liquid chillers with which the controller 200 may be coupled. Alternatively, similar display panels and input devices may be installed remotely from embodiments of the refrigerators, air chillers, or liquid chillers with which the controller 200 may be coupled.

The controller 200 may include a processor 210 that performs computations according to program instructions, a memory 220 that stores the computing instructions and other data used or generated by the processor 210, and a network interface 250 that includes data communications circuitry for interfacing to a data communications network 290 such as Ethernet, Galley Data Bus (GAN), or Controller Area Network (CAN). The processor 210 may include a microprocessor, a Field Programmable Gate Array, an Application Specific Integrated Circuit, or a custom Very Large Scale Integrated circuit chip, or other electronic circuitry that performs a control function. The processor 210 may also include a state machine. The controller 200 may also include one or more electronic circuits and printed circuit boards. The processor 210, memory 220, and network interface 250 may be coupled with one another using one or more data buses 280. The controller 200 may communicate with and control various sensors and actuators 270 of the refrigerator 100 via a control interface 260.

The controller 200 may be configured on or with an aluminum chassis or sheet metal box, which may be grounded and largely opaque to high-frequency energy transmission. Wires which carry high voltage and/or high frequency signals into or out of the refrigerator 100 may be twisted and/or shielded to reduce RF radiation, susceptibility, and EMI. Low frequency and low-voltage carrying wires may typically be filtered at the printed circuit board of the controller to bypass any high-frequency noise to ground.

The controller 200 may be controlled by or communicate with a centralized computing system, such as one onboard an aircraft. The controller 200 may implement a compliant ARINC 812 logical communication interface on a compliant ARINC 810 physical interface. The controller 200 may communicate via the Galley Data Bus (e.g., galley networked GAN bus), and exchange data with a Galley Network Controller (e.g., Master GAIN Control Unit as described in the ARINC 812 specification). In accordance with the ARINC 812 specification, the controller 200 may provide network monitoring, power control, remote operation, failure monitoring, and data transfer functions. The controller 200 may implement menu definitions requests received from the Galley Network Controller (GNC) for presentation on a GNC Touchpanel display device and process associated button push events to respond appropriately. The controller 200 may provide additional communications using an RS-232 communications interface and/or an infrared data port, such as communications with a personal computer (PC) or a personal digital assistant (PDA). Such additional communications may include real-time monitoring of operations of the refrigerator 100, long-term data retrieval, and control system software upgrades. In addition, the control interface 260 may include a serial peripheral interface (SPI) bus that may be used to communicate between the controller 200 and motor controllers within the refrigerator 100.

The refrigerator 100 may be configured to refrigerate beverages and/or food products which are placed in the refrigerated compartment 120. The refrigerator 100 may operate in one or more of several modes, including refrigeration, beverage chilling, and freezing. A user may select a desired temperature for the refrigerated compartment 120 using the control panel 140. The controller 200 included with the refrigerator 100 may control a temperature within the refrigerated compartment 120 at a high level of precision according to the desired temperature. Therefore, quality of food stored within the refrigerated compartment 120 may be maintained according to the user-selected operational mode of the refrigerator 100.

In various embodiments, the refrigerator 100 may maintain a temperature inside the refrigerated compartment 120 according to a user-selectable option among several preprogrammed temperatures, or according to a specific user-input temperature. For example, a beverage chiller mode may maintain the temperature inside the refrigerated compartment 120 at a user-selectable temperature of approximately 9 degrees centigrade (C), 12 degrees C., or 16 degrees C. In a refrigerator mode, the temperature inside the refrigerated compartment 120 may be maintained at a user-selectable temperature of approximately 4 degrees C. or 7 degrees C. In a freezer mode, the temperature inside the refrigerated compartment 120 may be maintained at a user-selectable temperature of approximately −18 degrees C. to 0 degrees C.

In various embodiments, the refrigerator 100 may also include a fan assembly, which may have a fan motor, a motor controller, a blower assembly, and an over-temperature thermostat. The fan assembly may be operationally coupled with a heat exchanger, evaporator, and/or condenser. The fan assembly may include an axial fan, a radial fan, a centrifugal fan, or another type of fan as known to one of ordinary skill in the art. The speed and direction of airflow through the fan may be set by a variably controlled electrical power used to drive a motor of the fan.

The refrigerator 100 may also include a plumbing system, which may have a liquid-to-air (e.g., forced convection) heat exchanger or a liquid conduction heat exchanger, a pressure vessel, a temperature control valve, a pressure relief burst disc, a temperature sensor, and one or more quick disconnects. In addition, the refrigerator 100 may include a power module having one or more printed circuit boards (PCB's), a wire harness, an ARINC connector, and/or a power conversion unit. The refrigerator 100 may also include ductwork and air interface components, and condensate drainage components.

The refrigerator 100 may also include one or more sensors such as temperature sensors and actuators. The sensors may be configured for air and refrigerant temperature sensing and pressure sensing, while the actuators may be configured for opening and closing valves. For example, an evaporator inlet air temperature sensor may measure the temperature of air returning from the refrigerated compartment 120 to an evaporator of a vapor cycle refrigeration system, an evaporator outlet air temperature sensor may measure the temperature of air supplied to the refrigerated compartment 120 from the evaporator, a condenser inlet air or liquid temperature sensor may measure the temperature of ambient air or inlet liquid in the vicinity of the refrigerator 100, and an exhaust air or liquid temperature sensor may measure the temperature of air exhausted or liquid outlet from the vapor cycle refrigeration system at a rear panel of the refrigerator 100. The controller 200 may use data provided by the sensors to control operation of the refrigerator 100 using the actuators.

The controller 200 may poll the sensors at a fixed minimum rate such that all data required to control the performance of the refrigerator 100 may be obtained by the controller 200 in time for real-time operation of the one or more cooling systems within the refrigerator 100. The polled values may be reported by the controller 200 via the RS-232 or infrared interface to a personal computer or PDA and may be reported over a controller area network (CAN) bus. The polled values may also be used in control algorithms by the controller 200, and may be stored to long-term memory or a data storage medium for later retrieval and analysis.

The controller 200 may provide a self-protection scheme to protect against damage to the refrigerator 100 and its constituent components due to abnormal external and/or internal events such as over-temperature conditions, over-pressure conditions, over-current conditions, etc. and shut down the refrigerator 100 and/or one or more of its constituent components in accordance with the abnormal event. The self-protection scheme may include monitoring critical system sensors and taking appropriate self-protection action when monitored data from the sensors indicate a problem requiring activation of a self-protection action. Such a self-protection action may prevent the refrigerator 100 and/or its constituent components from being damaged or causing an unsafe condition. The self-protection action may also provide appropriate notification via the display panel 160 regarding the monitored problem, the self-protection action, and/or any associated maintenance required. The controller's self-protection scheme may supplement, rather than replace, mechanical protection devices which may also be deployed within the refrigerator 100. The controller 200 may use monitored data from the sensors to intelligently restart the refrigerator 100 and reactivate the desired operational mode after the abnormal event which triggered the self-protection shutdown has terminated or reduced in severity.

The refrigerator 100 may be configured as a modular unit, and may be plug and play insert compatible with ARINC size 2 locations within the aircraft. The refrigerator 100 may have parts which are commonly shared with other galley inserts (GAINs), such as a refrigerator/oven unit. In some embodiments, the refrigerated compartment 120 may have an approximate interior volume of 40 liters for storing food items, and may be capable of storing 15 wine-bottle sized beverage bottles. In an exemplary embodiment, the refrigerator 100 may weigh approximately 14 kg when empty, and may have external dimensions of approximately 56.1 cm high, 28.5 cm wide, and 56.9 cm deep. Other embodiments may weigh more or less or have different external dimensions, depending on their application.

Figure 3:
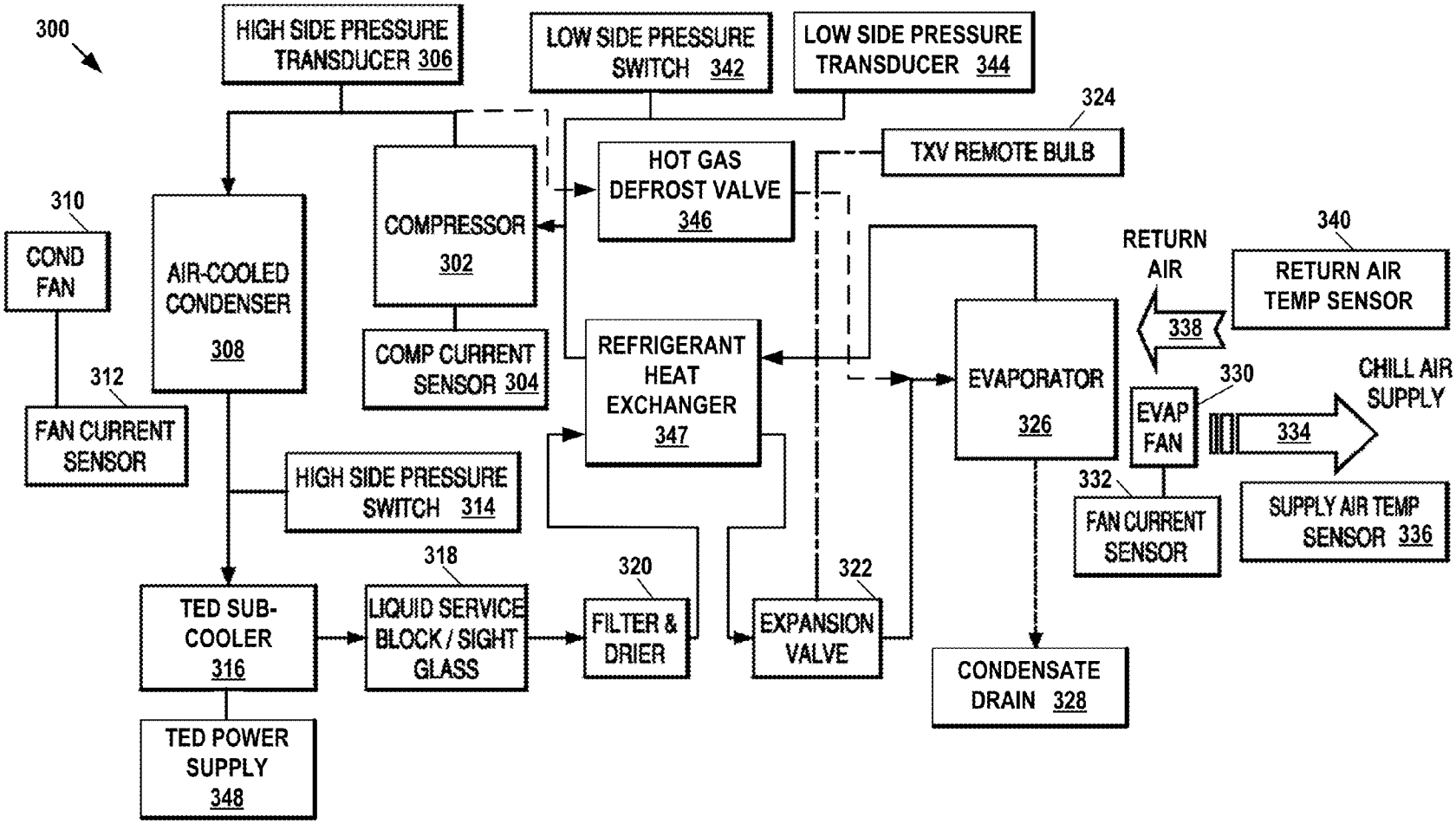
FIG. 3 is a schematic diagram of a vapor cycle refrigeration system including a thermoelectric device (TED) sub-cooler, according to an embodiment.

FIG. 3 is a schematic diagram of a vapor cycle refrigeration system 300 including a thermoelectric device (TED) sub-cooler 316, according to an embodiment. The refrigeration system 300 may be installed in the refrigerator 100 to cool the compartment 120. In other embodiments, the refrigeration system 300 may also be installed as a part of an air chiller or a liquid chiller. The refrigeration system 300 includes a vapor cycle system having motors and valves controlled by the controller 200 in response to communications received from a plurality of sensors. The motors, valves, and sensors may be examples of the sensors and actuators 270 of FIG. 2. The vapor cycle system of the refrigeration system 300 includes a refrigerant circulation loop that includes a compressor 302, an air-cooled condenser 308, a condenser fan 310, the TED sub-cooler 316, an expansion valve 322, an evaporator 326, an evaporator fan 330, and a refrigerant heat exchanger 347. In addition, the refrigeration system 300 includes a liquid service block/sight glass 318 and a refrigerant filter & drier 320 in the refrigerant circulation loop between the TED sub-cooler 316 and the expansion valve 322.

The refrigeration system 300 may be controlled by an electronic control system associated with the controller 200. The memory 220 of the controller 200 may store a program for performing a method of controlling the refrigeration system 300 executable by the processor 210. The method of controlling the refrigeration system 300 performed by the electronic control system may include a feedback control system such that the refrigeration system 300 may automatically maintain a prescribed temperature in the compartment 120.

The compressor 302, condenser 308, TED sub-cooler 316, sight glass 318, filter & driver 320, expansion valve 322, evaporator 326, and refrigerant heat exchanger 347 are connected by refrigerant tubing which contains refrigerant and facilitates the refrigerant moving between the vapor cycle system components over the course of the refrigeration cycle. The refrigerant is preferably one of R-134a, R404A, R236fa, and R1234yf, but may be any suitable refrigerant for a vapor cycle system as known in the art.

In operation, refrigerant enters the compressor 302 as low temperature, low pressure vapor. As refrigerant in vapor form is compressed in the compressor 302, the temperature and pressure of the refrigerant rise significantly such that the refrigerant may condense at ambient temperatures. Upon exiting the compressor 302, the refrigerant, in superheated vapor form, moves through the refrigerant tubing toward the condenser 308. Within the condenser 308, heat from the refrigerant is rejected and the refrigerant is condensed into a high pressure saturated liquid.

The condenser 308 is preferably air-cooled by use of condenser fan 310, which exhausts condenser air from the refrigeration system 300 and the enclosure 110. The enclosure 110 (or other enclosure enclosing the refrigeration system 300) may also include one or more condenser vents to facilitate a negative pressure created by the condenser fan 310 to pull fresh air into the enclosure 110 for circulation to cool the condenser 308. While an air-cooled condenser 308 is illustrated, in other embodiments, a liquid-cooled condenser may also be used. Upon exiting the condenser 308, the refrigerant passes through a high-temperature/high-pressure area of the refrigerant tubing.

The TED sub-cooler 316 may be disposed in the high-temperature/high-pressure area of the refrigerant tubing after the output of the condenser 308 to sub-cool the refrigerant. The temperature of the refrigerant tubing in this region may be approximately 20-35 degrees F. above ambient temperature. The TED sub-cooler 316 may cool the hot refrigerant therein, effectively pre-cooling the refrigerant prior to entering the expansion valve 326 and increasing the effectiveness of the condenser. The TED sub-cooler 316 may include one or more thermoelectric devices (TED) coupled with a thermoelectric cold side fluid heat exchanger on one side and an air cooled thermoelectric hot side heat sink on the other side. The TED may be coupled with the thermoelectric cold side fluid heat exchanger and/or the air cooled thermoelectric hot side heat sink using a thermal interface material. The TED may function using principles of the Peltier Effect, in which a voltage or DC current is applied across two dissimilar conductors, thereby creating an electrical circuit which transfers heat in a direction of charge carrier movement. The direction of heat transfer through the TED sub-cooler 316 is controlled by the voltage polarity across the TED.

The TED sub-cooler 316 may receive the voltage or DC current from a TED power supply 348. The TED power supply 348 may be controlled to turn the TED sub-cooler 316 on or off, or to set an operational value of the TED sub-cooler 316. For example, the TED power supply 348 may use pulse width modulation under control of the controller 200 to set an operational value of the TED sub-cooler 316.

In this manner, the TED sub-cooler 316 may transfer (i.e., pump) heat from the cold side fluid heat exchanger to the air cooled thermoelectric hot side heat sink. The cold side fluid heat exchanger may absorb heat from circulating refrigerant entering the TED sub-cooler 316 from the condenser 308. The TED sub-cooler 316 may transfer the heat absorbed by the cold side fluid heat exchanger to the air cooled thermoelectric hot side heat sink. The air cooled thermoelectric hot side heat sink may in turn transfer the heat to ambient air, or to air circulated by the condenser fan 310. The heat transferred by the heat sink also includes heat produced within the Peltier TED devices themselves.

After the sub-cooled refrigerant exits the TED sub-cooler 316, it preferably passes through a service block 318 including a sight glass and a filter/drier assembly 320. The filter and drier assembly 320 removes any moisture and solid contaminants from the refrigerant.

The refrigerant then passes through a refrigerant heat exchanger 347 for additional sub-cooling, in which heat is exchanged between the refrigerant liquid passing from the filter/drier assembly 320 to the expansion valve 322 and the refrigerant vapor passing from the evaporator 326 and the compressor 302. In particular, the refrigerant heat exchanger 347 performs a refrigerant liquid sub-cooling and refrigerant vapor superheating process by which the refrigerant passing from the filter/drier assembly 320 to the expansion valve 322 via the refrigerant heat exchanger 347 transfers heat to the refrigerant passing from the evaporator 326 to the compressor 302. By superheating the refrigerant before entering the compressor 302, droplets may be prevented from entering the compressor 302.

Following the refrigerant heat exchanger 347, the sub-cooled refrigerant then passes through an expansion valve 322. The expansion valve 322 drops a pressure of the refrigerant to a pressure corresponding to a user-selected operating state and temperature set-point of the refrigeration system 300. The expansion valve 322 also causes a sudden decrease in pressure of the liquid refrigerant, thereby causing flash evaporation of a portion of the liquid refrigerant.

The expansion valve 322 may include, for example, a block-type expansion valve with an internal sensing bulb. The expansion valve 322 may also be coupled with a thermal expansion remote bulb 324. The remote bulb 324 may be coupled with the expansion valve 322 by a capillary tube that communicates a working gas between the expansion valve 322 and the remote bulb 324 for sensing a temperature of the refrigerant leaving the evaporator 326. Thus, the expansion valve 322 may serve as a thermostatic expansion valve and operate to control a flow of refrigerant into the evaporator 326 according to a temperature of the refrigerant leaving the evaporator 326. After the cold liquid/vapor mixture exits the expansion valve 322, the refrigerant moves through the refrigerant tubing and enters the evaporator 326.

As the low temperature and low pressure refrigerant moves through the evaporator 326, the refrigerant absorbs the heat from the evaporator and lowers the temperature of the evaporator fins which then cool the air that circulates around the fins due to the operation of the evaporator fan 330. The cooled air circulated by the evaporator fan 330 becomes the chill air supply 334 that chills the interior of the compartment 120. Warmed air exits the interior of the compartment 120 as return air 338 and the evaporator fan 330 then circulates the return air 338 through the evaporator fins to be cooled and once again become chill air supply 334. The evaporator 326 is preferably located adjacent the compartment 120 such that air ducts may efficiently route the chill air supply 334 into the interior of the compartment 120 and route the return air 338 out of the interior of the compartment 120.

The transfer of thermal energy between the return air 338 circulating around the evaporator fins and the refrigerant flowing within the evaporator 326 converts the liquid refrigerant to vapor, which is then subsequently compressed by the compressor 302 as the vapor cycle system continues operation.

When the warm return air 338 passes over the cold surface of the evaporator 326, moisture in the air condenses on the evaporator fins in the form of condensate. This condensate is drained from the refrigeration system by the condensate drain 328 and discarded.

In embodiments in which the refrigeration system 300 is installed in a liquid chiller, the evaporator 326 is embodied as a liquid to refrigerant heat exchanger rather than an air to refrigerant heat exchanger as illustrated in FIG. 3. In such an embodiment, an evaporator fan 330 and fan current sensor 332 are not needed, and may be replaced with one or more components serving a complementary purpose in a liquid chiller system, e.g., a liquid pump and pump current sensor (not shown). Likewise, in embodiments in which the refrigeration system 300 is installed in a liquid chiller, input liquid coolant may replace the return air 338, chilled liquid coolant may replace the chill air supply 334, an input liquid coolant temperature sensor may replace the return air temperature sensor 340, and a chilled liquid coolant temperature sensor may replace the supply air temperature sensor 336 of FIG. 3. The chilled liquid coolant may then circulate through or adjacent to a refrigerated compartment similar to the compartment 120 in order to cool the interior thereof, and may circulate through a plurality of such compartments. The chilled liquid coolant may also circulate through other systems which include heat exchangers, e.g., liquid coolant to air heat exchangers, to provide cooling remote from the liquid chiller. The chilled liquid coolant may include water, a glycol/water mixture, a GALDEN heat transfer fluid, or other heat transfer fluids as known in the art.

When the refrigeration system 200 is placed in a defrost mode, a hot gas defrost valve 346 may be controlled to selectively route at least a portion of the hot vapor refrigerant directly from the output of the compressor 302 into an inlet of the evaporator 326 in order to defrost the evaporator fins of the evaporator 326. The hot gas defrost valve 346 may include a solenoid-controlled valve controlled by the controller 200.

The refrigeration system 300 includes a plurality of motors, sensors, and valve actuators 270 in communication with the controller 200. Motors and associated electrical current sensors include a fan motor that turns the condenser fan 310, a fan current sensor 312 that measures an electrical current of the fan motor for the condenser fan 310, a fan motor that turns the evaporator fan 330, a fan current sensor 332 that measures an electrical current of the fan motor for the evaporator fan 330, a compressor motor that drives the compressor 302, and a compressor current sensor 304 that measures an electrical current of the compressor motor that drives the compressor 302.

Temperature sensors include sensors that monitor temperatures of airflow through the refrigeration system 300 in various locations. The temperature sensors may include a thermistor, a thermocouple, or any suitable device known in the art for measuring temperature. The temperature sensors of the refrigeration system 300 include, but are not limited to, a supply air temperature sensor 336 that measures a temperature of the chill air supply 334 that enters the compartment 120, and a return air temperature sensor 340 that measures a temperature of the return air 338 that leaves the compartment 120 to be cooled once again by the evaporator 326.

Another set of sensors monitor temperature and/or pressures of refrigerant circulating through the refrigeration system 300. The pressure sensors may include a pressure transducer, a pressure switch, or any suitable device known in the art for sensing fluid pressure. The pressure sensors of the refrigeration system 300 include a low side pressure switch 342 and a low side pressure transducer 344 that sense pressure of the refrigerant at an input to the compressor 302, a high side pressure transducer 306 that senses pressure of the refrigerant at an output of the compressor 302, and a high side pressure switch 314 that senses pressure of the refrigerant at an output of the condenser 308. The low side pressure switch 342 will turn off the refrigerator 100 when the low side refrigerant pressure is below 10 psig, and the high side pressure switch 314 will turn off the refrigerator 100 when the high side refrigerant pressure is above 325 psig.

The controller may control operation of the TED sub-cooler 316 according to a selected mode and temperature set point of the refrigeration system 200. The TED sub-cooler 316 may be controlled using an on/off voltage control waveform, a variable voltage control waveform, or a pulse width modulation (PWM) voltage control waveform. The TED sub-cooler 316 may be provided the controlled waveform by controlling the TED power supply 348 to provide the desired controlled waveform to the TED sub-cooler 316.

The refrigeration system 300 may be used to pull down the temperature of the interior of the compartment 120 by a much larger amount in a much shorter period of time than is normally required during steady state operation when the temperature of the compartment 120 is typically already approximately the desired temperature set point, or at least much closer to the desired temperate set point than the ambient temperature. When the refrigeration system 300 is first operated, the heat load is typically larger than a steady state heat load. In addressing this large heat load, the TED sub-cooler 316 may be operated in conjunction with the rest of the vapor cycle system in order to pull down the temperature of the interior of the compartment 120 as quickly as possible. The TED sub-cooler 316 increases the sub-cooling of the liquid refrigerant, thereby increasing the performance of the evaporator 326 in removing heat from the return air 338 and cooling the chill air supply 334. Thus, the cooling capacity of the refrigeration system 300 is increased compared to operating the vapor cycle system alone, and the interior of the compartment 120 can be cooled more quickly. Once the compartment 120 reaches the target temperature set point, the TED sub-cooler 316 may be turned off and the vapor cycle system of the refrigeration system 300 may operate alone to address the steady state heat load of the compartment 120.

The use of the TED sub-cooler 316 in conjunction with the vapor cycle system of the refrigeration system 300 provides benefits over prior vapor cycle systems. By working together, the TED sub-cooler 316 and the vapor cycle system of the refrigeration system 300 pull down the temperature of the compartment 120 very quickly compared to prior systems to efficiently provide greater cooling to food products and beverages stored within the compartment 120. Once the large heat load of initial pull down of the temperature of the compartment 120 is addressed, the TED sub-cooler 316 may be turned off, and the vapor cycle system may operate independently to maintain the temperature of the compartment 120 while consuming less power.

If the vapor cycle system were to be designed to meet the increased heat load requirement of initial temperature pull down, the size, weight, and power consumption of the vapor cycle system components would need to be increased. These oversized components would then need to operate both during initial pull down and steady state operation, thereby increasing steady state power consumption compared to embodiments including the TED sub-cooler 316. In addition, the oversized components would also increase the weight of the vapor cycle system, thus increasing fuel costs of vehicles such as aircraft which would employ the system compared to embodiments including the TED sub-cooler 316. Thus, the use of thermoelectric devices facilitates a light weight and compact design for the TED sub-cooler 316 to increase the cooling capacity of the refrigeration system 300 without significantly increasing size and weight.

Figure 4:
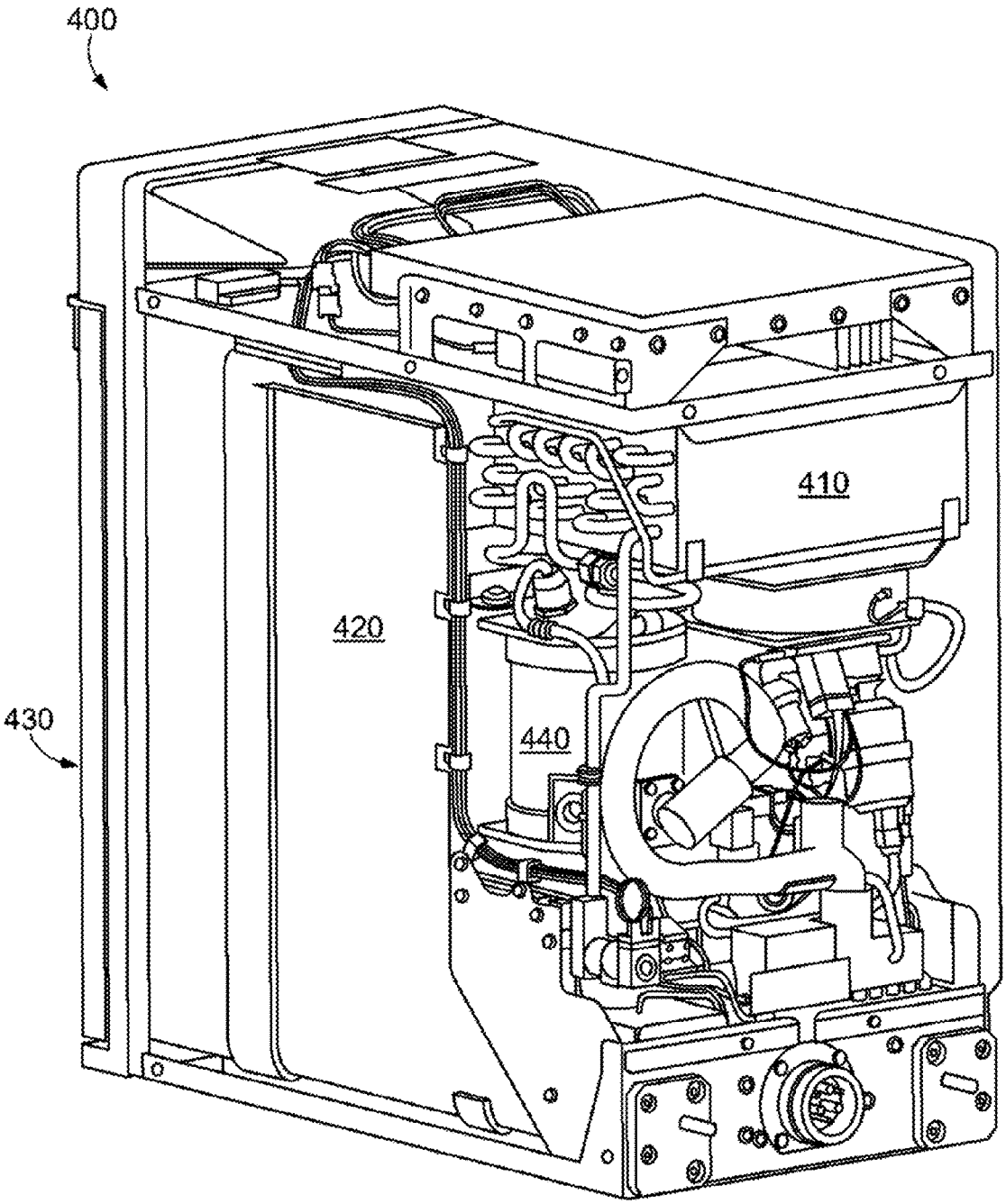
FIG. 4 illustrates a cut-away perspective rear view of an aircraft galley refrigerator having an integrated condenser and TED sub-cooler, according to an embodiment.

FIG. 4 illustrates a cut-away perspective rear view of an aircraft galley refrigerator 400 having an integrated condenser and TED sub-cooler 410, according to an embodiment. The refrigerator 400 may be an embodiment of the refrigerator 100 of FIG. 1. The refrigerator 400 may include a storage compartment 420 which is accessible from a front of the refrigerator 400 via a door 430. The condenser and TED sub-cooler 410 may be disposed at rear portion of the refrigerator 400 behind the storage compartment 420 and above a compressor 440.

Figure 5:
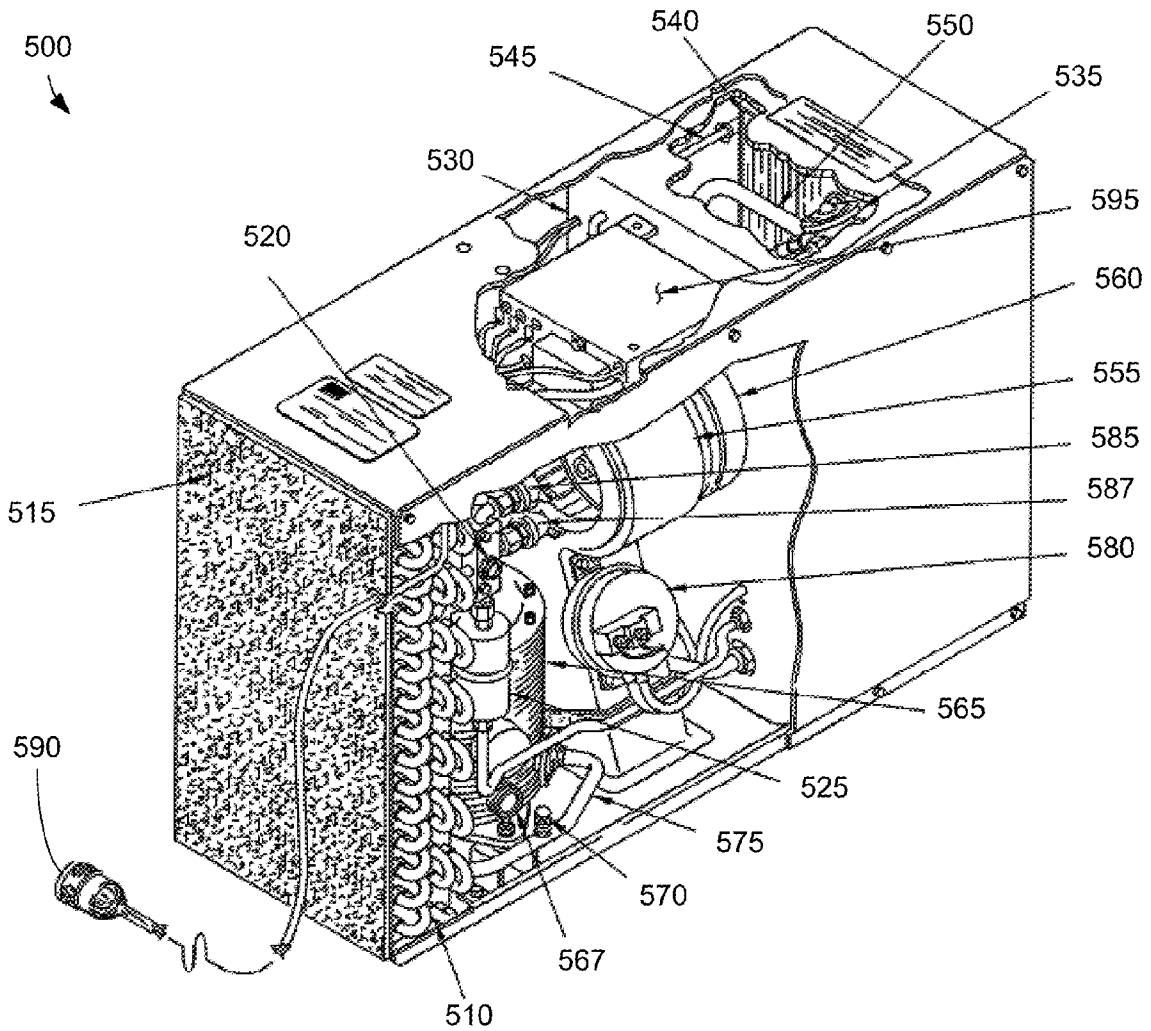
FIG. 5 illustrates a cut-away perspective view of an air chiller having an integrated condenser and TED sub-cooler, according to an embodiment.

FIG. 5 illustrates a cut-away perspective view of an air chiller 500 having an integrated condenser and TED sub-cooler 510, according to an embodiment. The air chiller 500 may be constructed and operate in a similar manner as the vapor cycle refrigeration system 300 of FIG. 3, except that the air chiller 500 may be installed remote from one or more storage compartments and provide a chill air supply to the one or more storage compartments via one or more air ducts (not shown). The condenser and TED sub-cooler 510 may be disposed at an end portion of the air chiller 500, with an air filter 515 installed adjacent to the condenser and TED sub-cooler 510 to filter air which is used to cool the condenser. The air chiller 500 may also include a manifold refrigerant sight glass 520 which corresponds to the sight glass 318 of FIG. 3 and a filter/drier 525 which corresponds to the filter/drier 320 of FIG. 3 in the refrigerant flow path following the condenser and TED sub-cooler 510. In addition, the air chiller 500 may include an evaporator housing 530 which houses a thermal expansion valve (TEV) 535 coupled with an evaporator assembly 540, which correspond to the expansion valve 322 and the evaporator 326 of FIG. 3, respectively. The evaporator housing 540 may also house an evaporator temperature sensing thermistor 545 and a refrigerant heat exchanger 550. The refrigerant heat exchanger 550 corresponds to the refrigerant heat exchanger 347 of FIG. 3. An evaporator fan (not shown) may cause air to be chilled by the evaporator assembly 540 and circulate to various locations, for example, a refrigerated beverage or food compartment in an aircraft galley, via one or more air ducts (not shown).

A blower housing 555 may house a blower motor 560 that causes air to circulate through the condenser and TED sub-cooler 510 in a manner similar to the condenser fan 310 of FIG. 3. The blower motor may include an overheating/overcurrent protector.

A compressor 565 may be disposed prior to the condenser and TED sub-cooler 510 in the refrigerant path of the air chiller 500. The compressor 565 corresponds to the compressor 302 of FIG. 3. The compressor 565 may include an overhearing/overcurrent protector and a high pressure (HP) access valve. A low pressure (LP) access valve 570 may be disposed along a suction tube 575 at a refrigerant input to the compressor 565. The compressor 565 may also include a sight glass 567. The air chiller 500 may also include an evaporator defrost switch 580, an HP switch 585 which corresponds to the high side pressure switch 314 of FIG. 3, and an LP switch 587 which corresponds to the low side pressure switch 342 of FIG. 3. The air chiller 500 may also include power and control electronics including a receptacle 590 which provides electrical power and control communications to the air chiller 500 and an electromagnetic interference (EMI) filter 595.

Figure 6:
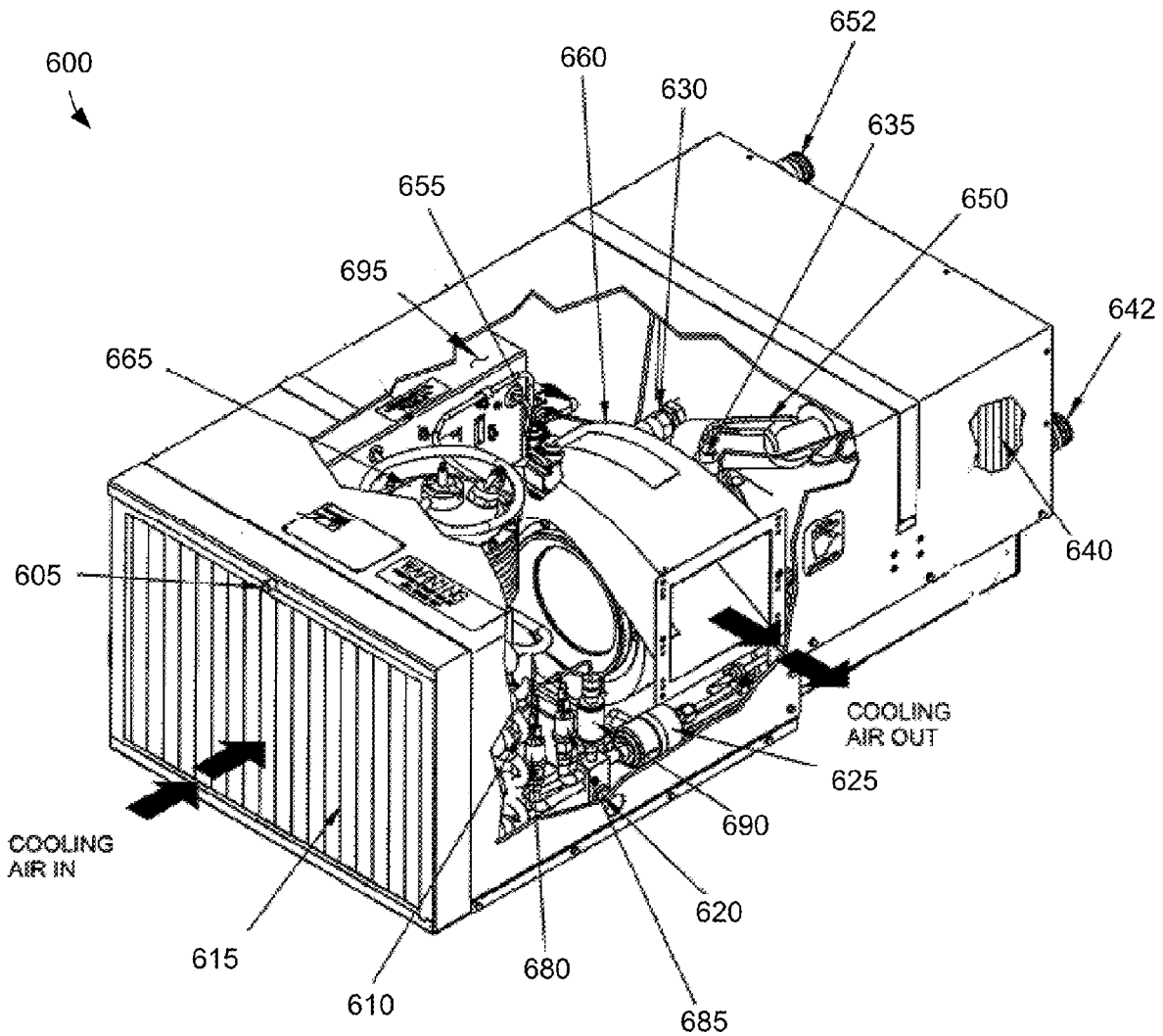
FIG. 6 illustrates a cut-away perspective view of a liquid chiller having an integrated condenser and TED sub-cooler, according to an embodiment.

FIG. 6 illustrates a cut-away perspective view of a liquid chiller 600 having an integrated condenser and TED sub-cooler 610, according to an embodiment. The liquid chiller 600 may be constructed and operate in a similar manner as the vapor cycle refrigeration system 300 of FIG. 3, except that the liquid chiller 600 may be installed remote from one or more storage compartments and provide chilled liquid coolant to the one or more storage compartments via one or more chilled liquid coolant lines. The condenser and TED sub-cooler 610 may be disposed at an end portion of the liquid chiller 600, with an air filter 615 installed adjacent to the condenser and TED sub-cooler 610 to filter air which is used to cool the condenser. The air filter 615 may be replaceable by opening a cover over the air filter 615 using a spring loaded plunger 605.

The liquid chiller 600 may also include a refrigerant sight glass 620 which corresponds to the sight glass 318 of FIG. 3 and a filter/drier 625 which corresponds to the filter/drier 320 of FIG. 3 in the refrigerant flow path following the condenser and TED sub-cooler 610. In addition, the air chiller 600 may include an evaporator assembly 640 having a pressure relief valve and a thermistor. The evaporator assembly 640 may receive liquid coolant from a liquid coolant circulation system via a coolant inlet quick disconnect 642 and output chilled liquid coolant to the liquid coolant circulation system via a coolant outlet quick disconnect 652. A refrigerant heat exchanger 650, which may also includes a thermistor, may be coupled with the evaporator assembly 640. The refrigerant heat exchanger 650 corresponds to the refrigerant heat exchanger 347 of FIG. 3. A thermal expansion valve (TEV) 635 may be coupled with the evaporator assembly 640. The TEV 635 corresponds to the expansion valve 322 of FIG. 3.

A blower motor assembly 660 may cause air to flow through the air filter 615, through the condenser and TED sub-cooler 610, and then out of an enclosure of the liquid chiller 600. The blower motor assembly 660 may include an overheating/overcurrent protector such as a thermistor and fuses.

A compressor 665 may be disposed prior to the condenser and TED sub-cooler 610 in the refrigerant path of the liquid chiller 600. The compressor 665 corresponds to the compressor 302 of FIG. 3. The compressor 665 may include an overhearing/overcurrent protector such as a thermistor and fuses. The liquid chiller 600 may also include a low pressure switch 680 and a high pressure switch 685 which correspond to the low side pressure switch 342 and the high side pressure switch 314 of FIG. 3, respectively, as well as a pressure transducer 690. The air chiller 600 may also include power and control electronics including a capacitor assembly 655 having a thermistor and an electromagnetic interference (EMI) filter 695. The liquid chiller 600 also may include a hot gas bypass valve (HGBV) assembly 630, which corresponds to the hot gas defrost valve 346 of FIG. 3.

Figure 7:
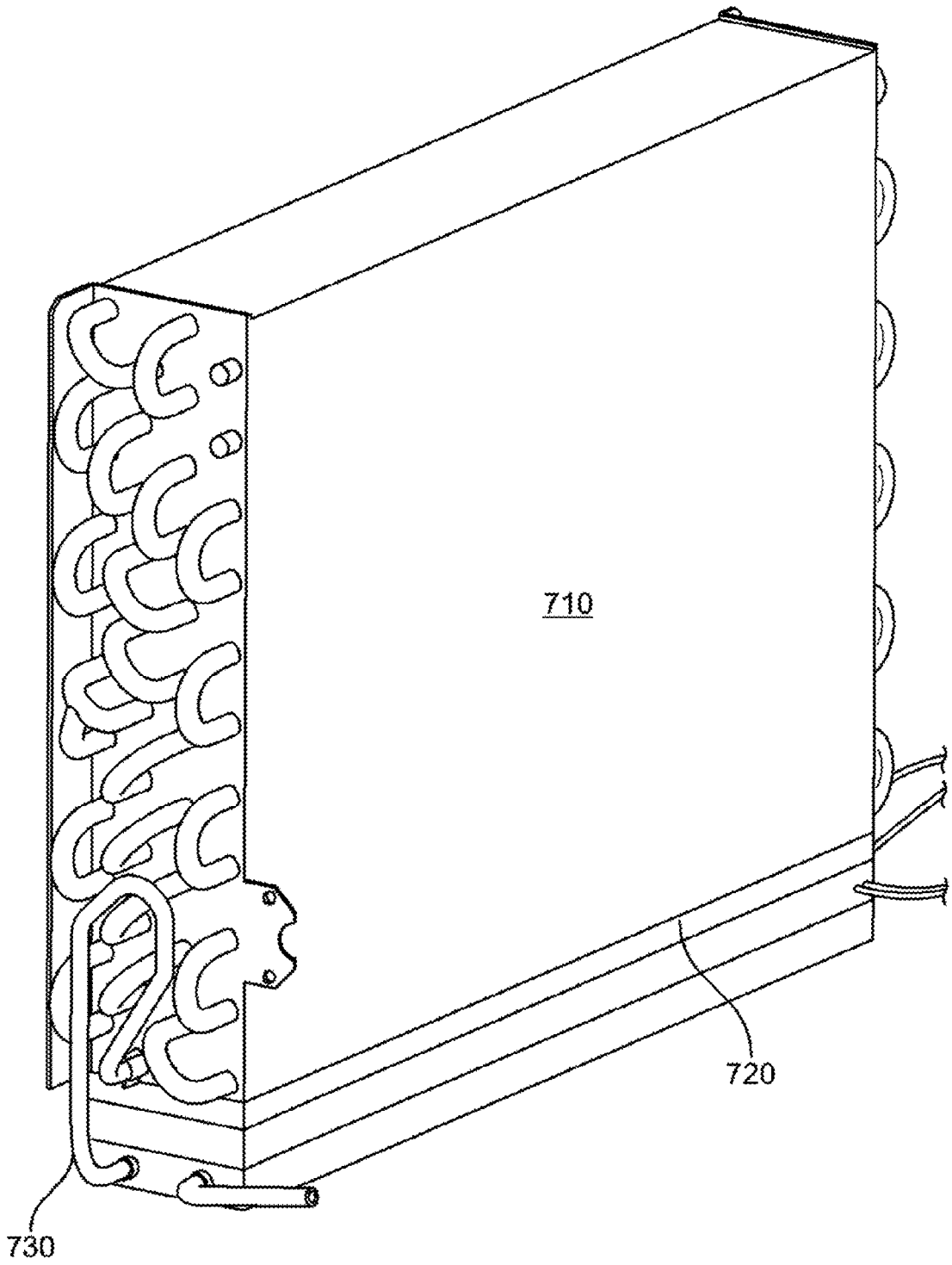
FIG. 7 illustrates an integrated refrigerant condenser and TED sub-cooler assembly, according to an embodiment.

FIG. 7 illustrates an integrated refrigerant condenser and TED sub-cooler assembly 700, according to an embodiment. The condenser and TED sub-coolers 410, 510, and 610 may be embodiments of the condenser and TED sub-cooler assembly 700. As shown in FIG. 7, the refrigerant condenser 710 may occupy the largest portion of the integrated refrigerant condenser and TED sub-cooler assembly 700 including numerous coils which circulate refrigerant therein, and the TED sub-cooler 720 may be positioned at one end of the integrated refrigerant condenser and TED sub-cooler assembly 700 having electrical wires connected thereto to couple with a TED power supply, for example, the TED power supply 348 of FIG. 3. After the refrigerant passes through the refrigerant condenser 710, a refrigerant tube 730 may circulate the refrigerant through the TED sub-cooler 720 to subcool the refrigerant. By integrating the refrigerant condenser 710 and the TED sub-cooler 720 into an integrated refrigerant condenser and TED sub-cooler assembly 700, the combination may be more efficient, lighter, and more cost-effective than if the components were physically separate.

Figure 8:
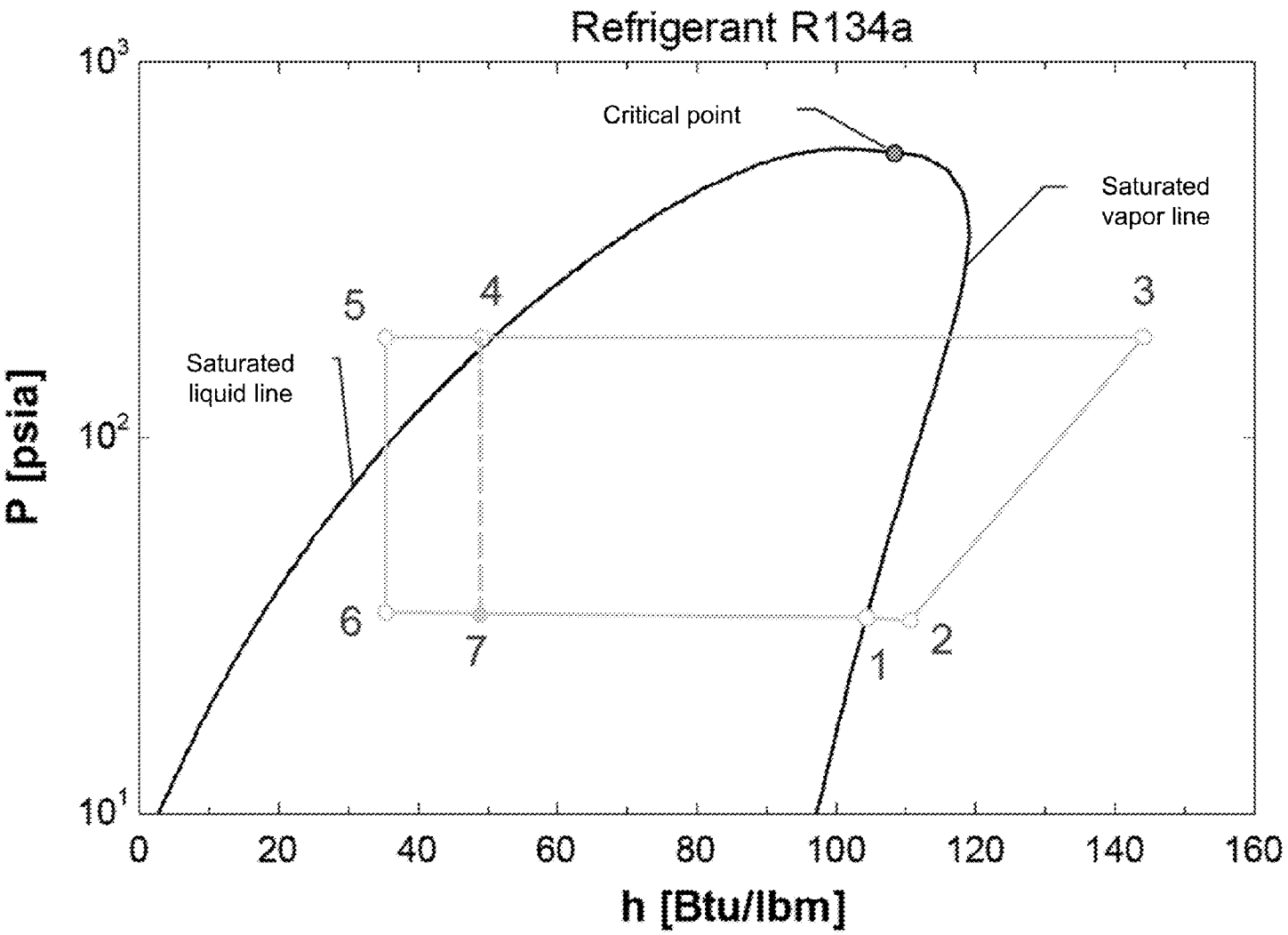
FIG. 8 illustrates a pressure-entropy diagram of a mechanical vapor-compression refrigeration cycle with a TED sub-cooler, according to an embodiment.

FIG. 8 illustrates a pressure-entropy diagram of a mechanical vapor-compression refrigeration cycle with a TED sub-cooler, according to an embodiment. The diagram of FIG. 8 may be representative of the vapor cycle refrigeration system 300 illustrated in FIG. 3 operating in an ideal vapor compression cycle process. As shown in FIG. 8, a state of a refrigerant cycles through a number of states within the refrigeration cycle as defined by the relationship between pressure (P shown in units of pounds per square inch absolute [psia]) and entropy (h shown in units of British thermal units per pound mass [Btu/lbm]) of the refrigerant R134a. Starting from a state 2, the refrigerant vapor is compressed isentropically to a higher temperature and pressure beyond the saturated vapor line to state 3. Then, the compressed vapor is condensed isobarically from state 3 to state 4, which results in heat rejection to the surroundings.

If the TED sub-cooler (e.g., the TED sub-cooler 316 of FIG. 3) is turned off, the next step is in the cycle is adiabatic throttling of the refrigerant from state 4 to low temperature and pressure below the saturated liquid line to state 7. In the final step, the refrigerant is evaporated isobarically at low temperature and pressure from state 7 to state 1, which results in the absorption of heat from its surroundings. The cooling capacity of the system without a TED sub-cooler is computed according to the following equation: $Q_{withoutTED}=(h_1-h_7)\cdot m$, which indicates that the cooling capacity of the system is the multiplication of refrigerant mass flow rate and the difference between the entropy at state 1 and the entropy at state 7.

Alternatively, if the TED sub-cooler is turned on, the next step after state 4 is to further sub-cool the refrigerant using the TED sub-cooler from state 4 to state 5 above the saturated liquid line. Then, the refrigerant is adiabatically throttled to the low temperature and pressure state 6 below the saturated liquid line. Finally, the refrigerant is evaporated isobarically at low temperature and pressure, which results in the absorption of heat from its surroundings, from state 6 to 1. The cooling capacity of the system using the TED sub-cooler is computed according to the following equation: $Q_{withoutTED}=(h_1-h_6)\cdot m$, which indicates that the cooling capacity of the system is the multiplication of refrigerant mass flow rate and the difference between the entropy at state 1 and the entropy at state 6.

As illustrated by the pressure-entropy diagram of FIG. 8, the TED sub-cooler may provide an additional cooling capacity to the mechanical vapor-compression refrigeration cycle according to the equation $Q_{TED}=(h_7-h_6)\cdot m$. Note that additional heat may be added to the refrigerator's discharge air for the additional energy (electricity) input to the TED sub-cooler. The refrigeration cycle is then repeated continuously, with the progression from state 4 to state 1 depending upon whether the TED sub-cooler is operating or not.

Figure 9:
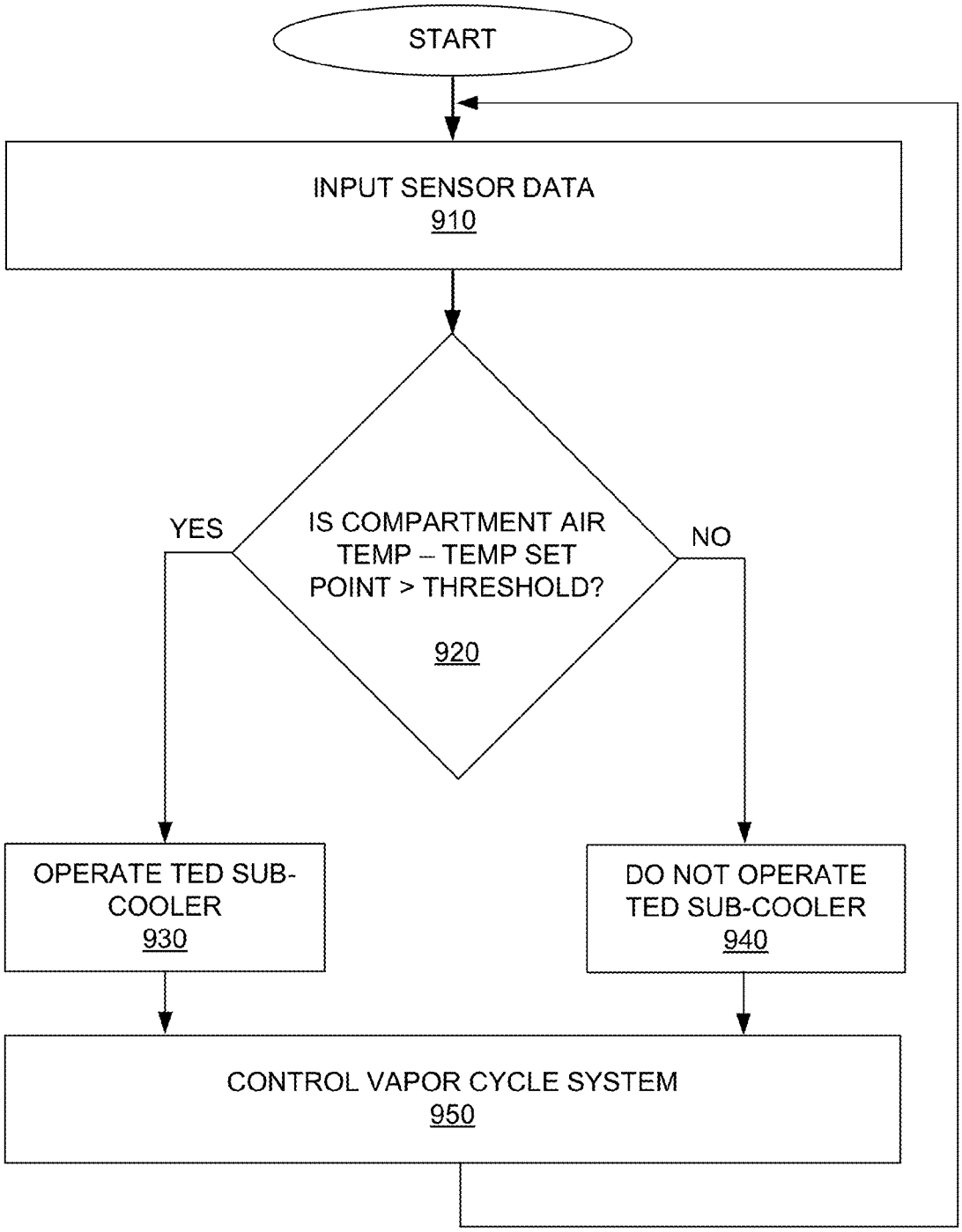
FIG. 9 illustrates a method of controlling a vapor cycle refrigeration system including a TED sub-cooler, according to an embodiment.

FIG. 9 illustrates a method of controlling a vapor cycle refrigeration system including a TED sub-cooler, according to an embodiment. In a step 910, sensor data from the various sensors within the refrigeration system 300 are input for processing by the controller 200. In a step 920, a determination is made as to whether a difference between the temperature of the interior of the compartment 120 and the temperature set point is greater than a threshold. The threshold may be set such that during start-up for the refrigeration system 300, when the heat load is much larger than steady state, the difference exceeds the threshold; but during steady state operation, when the heat load of the refrigeration system 300 is normal, the difference does not exceed the threshold. For example, the threshold may be set to approximately twenty degree, ten degrees, five degrees, four degrees, or two degrees. In essence, step 920 determines whether the evaporator 326 of the refrigeration system 300 would benefit from the extra cooling capacity provided by the TED sub-cooler 316. If the determination from step 920 is in the affirmative, the method proceeds to step 930 in which the TED sub-cooler 316 is operated in conjunction with the vapor cycle system of the refrigeration system 300. Otherwise, the method proceeds to step 940 in which the TED sub-cooler 316 is not operated. In step 950, the vapor cycle system of the refrigeration system 300 is controlled by the controller 200 to achieve and maintain the temperature set point within the compartment 120 according to the set mode of the refrigeration system 300, the sensor data input in step 910, and the decision made in step 920. The method returns to step 910 and repeats, so that after the TED sub-cooler 316 is operated during initial pull down of the temperature of the compartment 120, the TED sub-cooler 316 is turned off and the temperature of the compartment 120 is maintained by the rest of the vapor cycle system operating without the additional assistance from the TED sub-cooler 316.

All references, including publications, patent applications, and patents, cited herein are hereby incorporated by reference to the same extent as if each reference were individually and specifically indicated to be incorporated by reference and were set forth in its entirety herein.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The terminology used herein is for the purpose of describing the particular embodiments and is not intended to be limiting of exemplary embodiments of the invention.

The apparatus described herein may comprise a processor, a memory for storing program data to be executed by the processor, a permanent storage such as a disk drive, a communications port for handling communications with external devices, and user interface devices, including a display, keys, etc. When software modules are involved, these software modules may be stored as program instructions or computer readable code executable by the processor on a non-transitory computer-readable media such as read-only memory (ROM), random-access memory (RAM), CD-ROMs, DVDs, magnetic tapes, hard disks, floppy disks, and optical data storage devices. The computer readable recording media may also be distributed over network coupled computer systems so that the computer readable code is stored and executed in a distributed fashion. This media may be read by the computer, stored in the memory, and executed by the processor.

Also, using the disclosure herein, programmers of ordinary skill in the art to which the invention pertains may easily implement functional programs, codes, and code segments for making and using the invention.

The invention may be described in terms of functional block components and various processing steps. Such functional blocks may be realized by any number of hardware and/or software components configured to perform the specified functions. For example, the invention may employ various integrated circuit components, e.g., memory elements, processing elements, logic elements, look-up tables, and the like, which may carry out a variety of functions under the control of one or more microprocessors or other control devices. Similarly, where the elements of the invention are implemented using software programming or software elements, the invention may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the invention may employ any number of conventional techniques for electronics configuration, signal processing and/or control, data processing and the like. Finally, the steps of all methods described herein may be performed in any suitable order unless otherwise indicated herein or otherwise clearly contradicted by context.

For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. The words "mechanism" and "element" are used broadly and are not limited to mechanical or physical embodiments, but may include software routines in conjunction with processors, etc.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the spirit and scope of the invention as defined by the following claims. Therefore, the scope of the invention is defined not by the detailed description of the invention but by the following claims, and all differences within the scope will be construed as being included in the invention.

No item or component is essential to the practice of the invention unless the element is specifically described as "essential" or "critical". It will also be recognized that the terms "comprises," "comprising," "includes," "including," "has," and "having," as used herein, are specifically intended to be read as open-ended terms of art. The use of the terms "a" and "an" and "the" and similar referents in the context of describing the invention (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from another. Furthermore, recitation of ranges of values herein are merely intended to serve as a shorthand method of referring individually to each separate value falling within the range, unless otherwise indicated herein, and each separate value is incorporated into the specification as if it were individually recited herein.

What is claimed is:

1. A refrigeration system that cools a compartment, the refrigeration system comprising:

a compressor, a condenser, a thermoelectric device (TED) sub-cooler including at least one TED, the TED sub-cooler including a hot side heat sink integrated with and in thermal communication with the condenser on a same hot side of the at least one TED, the hot side heat sink sharing a cooling mechanism integrated with the condenser by which the hot side heat sink is to be cooled together with the condenser, and the TED sub-cooler including on an opposite side of the at least one TED a cold side fluid heat exchanger to sub-cool refrigerant that has passed through the condenser, an expansion valve, an evaporator, and tubing adapted to transport the refrigerant through the refrigeration system in a circulation order from the compressor to the condenser to the TED sub-cooler to the expansion valve to the evaporator and back to the compressor again.

2. The refrigeration system of claim 1, wherein the TED sub-cooler sub-cools the refrigerant exiting the condenser by at least approximately ten degrees Fahrenheit.

3. The refrigeration system of claim 1, wherein the TED sub-cooler operates when a difference between a measured temperature in the compartment and a temperature set point is greater than or equal to a preset threshold, and does not operate when the difference is less than the preset threshold.

4. The refrigeration system of claim 3, wherein the preset threshold is between approximately two and ten degrees Fahrenheit.

5. The refrigeration system of claim 1, further comprising a condenser fan that circulates air to cool both the condenser and the hot side heat sink of the TED sub-cooler.

6. The refrigeration system of claim 1, wherein the TED sub-cooler is powered by direct electrical current.

7. The refrigeration system of claim 1, wherein the TED sub-cooler is controlled using a Pulse Width Modulation control signal.

8. The refrigeration system of claim 1, further comprising an enclosure that encloses the compartment and the refrigeration system, the enclosure having a door that provides closeable access to the compartment and vents through which a condenser fan outputs condenser exhaust and inputs ambient air for cooling the condenser and the TED sub-cooler.

9. The refrigeration system of claim 1, further comprising a controller that controls the refrigeration system according to sensor data from temperature and pressure sensors in the refrigeration system.

10. The refrigeration system of claim 9, wherein the controller is remotely controlled using a computer system which communicates with the controller over a data communications network.

11. The refrigeration system of claim 1, further comprising a refrigerant heat exchanger that superheats refrigerant entering the compressor using refrigerant upstream of the expansion valve.

12. A method of controlling a refrigeration system comprising a compressor, a condenser, a thermoelectric device (TED) sub-cooler including at least one TED, the TED sub-cooler including a hot side heat sink integrated with and in thermal communication with the condenser on a same hot side of the at least one TED, the hot side heat sink sharing a cooling mechanism integrated with the condenser by which the hot side heat sink is to be cooled together with the condenser, and the TED sub-cooler including on an opposite side of the at least one TED a cold side fluid heat exchanger to sub-cool refrigerant after passing through the condenser, an expansion valve, an evaporator, and tubing adapted to transport the refrigerant through the refrigeration system in a circulation order from the compressor to the condenser to the TED sub-cooler to the expansion valve to the evaporator and back to the compressor again, the method comprising:

inputting sensor data;

determining whether a measured temperature of the compartment is greater than or equal to a preset threshold;

controlling the TED sub-cooler when the temperature is greater than or equal to the preset threshold;

not operating the TED sub-cooler when the temperature is less than the preset threshold;

when operating the TED sub-cooler, cooling the hot side heat sink together with the condenser, and sub-cooling the refrigerant after passing through the condenser; and controlling motors and valves of the refrigeration system according to the sensor data to maintain a set temperature of the compartment within a predetermined maintenance range.

13. The method of claim 12, wherein the TED sub-cooler sub-cools the refrigerant exiting the condenser by at least approximately ten degrees Fahrenheit (F).

14. The method of claim 12, wherein the preset threshold is between approximately two and ten degrees F.

15. The method of claim 12, further comprising circulating air to cool both the condenser and a hot side heat sink of the TED sub-cooler using a fan.

16. The method of claim 12, wherein the TED sub-cooler is powered by direct electrical current.

17. The method of claim 12, wherein the TED sub-cooler is controlled using a Pulse Width Modulation control signal.

18. The method of claim 12, wherein the sensor data is received from temperature and pressure sensors in the refrigeration system.

19. The method of claim 12, further comprising remotely controlling the refrigeration system using a computer system which communicates with the controller over a data communications network.

20. The method of claim 12, further comprising superheating the refrigerant upstream of the compressor by a refrigerant heat exchanger using refrigerant upstream of the expansion valve.

* * * * *